US005203188A

United States Patent [19]

Osgood et al.

[11] Patent Number: 5,203,188

[45] Date of Patent: Apr. 20, 1993

[54] SYSTEM AND METHOD FOR MONITORING A ROLLING MILL

[75] Inventors: Peter N. Osgood, Upton; Thomas E. Simmons, Westborough, both of Mass.

[73] Assignee: Morgan Construction Company, Worceter, Mass.

[21] Appl. No.: 760,600

[22] Filed: Sep. 16, 1991

[51] Int. Cl.[5] ..... B21C 51/00; G06G 7/19

[52] U.S. Cl. ..... 72/11; 72/31; 72/234; 364/472; 364/576

[58] Field of Search ..... 72/6-8, 72/11, 16, 20, 21, 234, 2, 31-36; 73/862.55; 364/472, 571.02, 576

[56] References Cited

U.S. PATENT DOCUMENTS

| | | | |
|---|---|---|---|
| 3,694,636 | 9/1972 | Smith, Jr. | 72/8 |
| 3,889,504 | 6/1975 | Ichiryu et al. | 72/8 |
| 3,928,994 | 12/1975 | Ichiryu et al. | 72/8 |
| 4,038,848 | 8/1977 | Ichiryu et al. | 72/8 |
| 4,060,716 | 11/1977 | Pekrul et al. | 364/576 |
| 4,222,254 | 9/1980 | King, Jr. et al. | 72/8 |
| 4,691,547 | 9/1987 | Teoh et al. | 72/8 |
| 4,745,556 | 5/1988 | Turley | 364/472 |
| 4,763,273 | 8/1988 | Anbe et al. | 364/472 |
| 4,872,245 | 10/1989 | Kawasaki et al. | 72/234 |
| 4,907,433 | 3/1990 | Larson et al. | 72/8 |
| 4,910,985 | 3/1990 | Ballyns | 72/8 |
| 4,936,132 | 6/1990 | Kato et al. | 72/240 |

FOREIGN PATENT DOCUMENTS

| | | | |
|---|---|---|---|
| 0277850 | 4/1990 | Fed. Rep. of Germany | 72/8 |
| 0108404 | 4/1990 | Japan | 72/31 |
| 0915993 | 3/1982 | U.S.S.R. | 72/7 |

OTHER PUBLICATIONS

Barnes, et al., "Close tinplate gage tolerance through low-cost technological improvements," *Iron and Steel Engineer* (Jan. 1988), pp. 49-55.

Cory, Jr., et al., "Roll eccentricity monitoring for strip quality control," *Iron and Steel Engineer* (Feb. 1990), pp. 24-26.

Ginzburg, *Roll Eccentricity*, pp. 22-25, Int. Rolling Mill Consultants Inc., Pittsburgh, Pa. 1990.

*Primary Examiner*—Lowell A. Larson
*Assistant Examiner*—Thomas C. Schoeffler
*Attorney, Agent, or Firm*—Samuels, Gauthier & Stevens

[57] ABSTRACT

A system and method for monitoring a rolling mill which includes a data acquisition module that continually acquires, from mill instrumentation computers, time domain data relating to finished product gauge, entering product gauge, separating forces occurring at each roll stand in the mill, and RPMs of each roll in the roll stands over a calculated data acquisition time period. A monitoring CPU transforms the acquired data into the frequency domain in response to the rolls operating at an approximately constant speed over the data acquisition time period. A frequency spectrum correlation analysis is performed with the frequency domain data in order to identify the specific contributions to frequency amplitudes occurring in the finished product gauge frequency domain data. A determination is then made as to whether the identified frequency amplitudes exceed predetermined thresholds which correspond to a predetermined warning level and a maximum tolerance level of the finished product. A graphical display of those mill components contributing to near and out of tolerance finished product is provided.

58 Claims, 8 Drawing Sheets

SYSTEM AND METHOD FOR MONITORING A ROLLING MILL

BACKGROUND OF THE INVENTION

The invention relates to systems and methods for monitoring the operation of rolling mills, and more particularly to such systems and methods which provide information relating to specific mill components which contribute to gauge tolerance variations in the product produced by the mill.

The invention will hereinafter be described in connection with the rolling of strips or other like flat products. It is to be understood, however, that the invention may be equally applicable to the rolling of other products, including but not limited to rounds and shapes.

The quality of the finish strip produced by modern rolling mills is dependent upon many factors, including in particular roll eccentricity of the work rolls and/or the back-up rolls and/or intermediate rolls, ovality of the rolls, and problems with the roll bearings.

The eccentricity of either the work, intermediate, or back-up rolls may adversely affect the quality of the finish strip, typically by producing a regular reoccurring variation in thickness or gauge of the material being rolled. Minimizing such tolerance variations is highly desirable because of the more efficient use of materials and the economic savings relating thereto. Consumers of the finish strip often require that the gauge of the strip be as constant as possible within predetermined tolerance limits. Therefore, it is an economic necessity for rolling mills to identify and closely monitor specific causes to tolerance variations in the finish strip.

It is desirable, therefore, to have a system for continuously monitoring the eccentricity contribution of each roll to the gauge variations of the finish strip so that the mill operators would be able to make roll changes prior to the variations in the finish strip from becoming out of tolerance. If the mill operators are able to predict the proper timing of roll changes, the result will be an overall increase in the cost effectiveness in the mill. In addition to an increase of in tolerance finished product, the mill itself will be less subject to unscheduled down time due to undetected roll problems. Furthermore, it would also be helpful to mill operators to monitor the contribution of the entering product to tolerance variations in the finished product, a factor widely ignored in the industry.

Frequency spectrum analysis has been utilized in conventional roll monitoring systems for determining roll contribution to finish strip gauge variation. Briefly, the approach involves the transformation of time domain data relating to measured finish strip gauge signals, typically provided by an x-ray gauge, a nuclear gauge, or a laser, and roll motor tachometer signals into the frequency domain. The gauge frequency data is correlated with the roll frequency data in order to identify which roll or rolls are contributing to out of tolerance finish strip.

Such systems may experience difficulties in distinguishing particular roll contribution when the rolling mill utilizes multiple rolling stands with multiple rolls in each stand. This may be caused by operating frequency harmonics of multiple rolls becoming aligned or overlapping during the correlation of the data, thus causing roll identification problems. In addition, such frequency analysis systems may experience problems when the mill is not operating at an approximate constant speed. Because of the required data sampling in frequency analysis, the effect may be the smearing, widening or indistinguishing of amplitude peaks in the frequency spectrum, thereby making it difficult or impossible to relate specific roll contribution to the out of tolerance finish strip.

SUMMARY OF THE INVENTION

It is therefore an object of the present invention to provide a rolling mill monitoring system and method which provides an accurate prediction and indication of specific contributions to out of tolerance finish strip.

It is another object of the present invention to provide a rolling mill monitoring system and method which utilizes a frequency spectrum analysis on data corresponding to finish strip gauge, separating forces of each rolling stand, and roll frequencies derived from roll speed in order to identify specific roll contributions to out of tolerance finish strip.

It is still another object of the present invention to provide a rolling monitoring system and method which utilizes a frequency spectrum analysis of data corresponding to the entering strip gage and the finish strip gage in order to identify the contribution of the entering strip to out of tolerance finish strip.

In order to achieve these and other objects of the present invention there is provided a system and method for monitoring a rolling mill which includes a data acquisition module that continually acquires, from mill instrumentation computers, time domain data relating to finished product gauge, entering product gauge, separating forces occurring at each roll stand in the mill, and RPMs of each stand drive motors over a calculated data acquisition time period. A monitoring CPU transforms the acquired data into the frequency domain in response to the mill operating at an approximately constant speed over the data acquisition time period. A frequency spectrum correlation analysis is performed with the frequency domain data in order to identify the specific mill contributions to finished product gauge variations. A determination is then made as to whether the identified frequency amplitude peaks exceed predetermined limits which correspond to predetermined maximum tolerance levels of the finished product. Initially, frequencies with significant amplitudes (or peaks) are found in the finished product gauge FFT and the separating force FFTs. A comparison is then made to determine whether the finish product gauge peaks have the same frequencies as the separating force peaks. If there is a match, the specific roll is identified. Each roll frequency that does not have a matched peak is assigned the amplitude from the finish product gauge FFT at its frequency. These amplitudes are then normalized and multiplied by the actual strip variation. Therefore, this relates each roll's contribution to actual strip variation. A graphical display of those mill components contributing to near and out of tolerance finished product is provided.

DETAILED DESCRIPTION OF THE ILLUSTRATED EMBODIMENT

Figure 1:
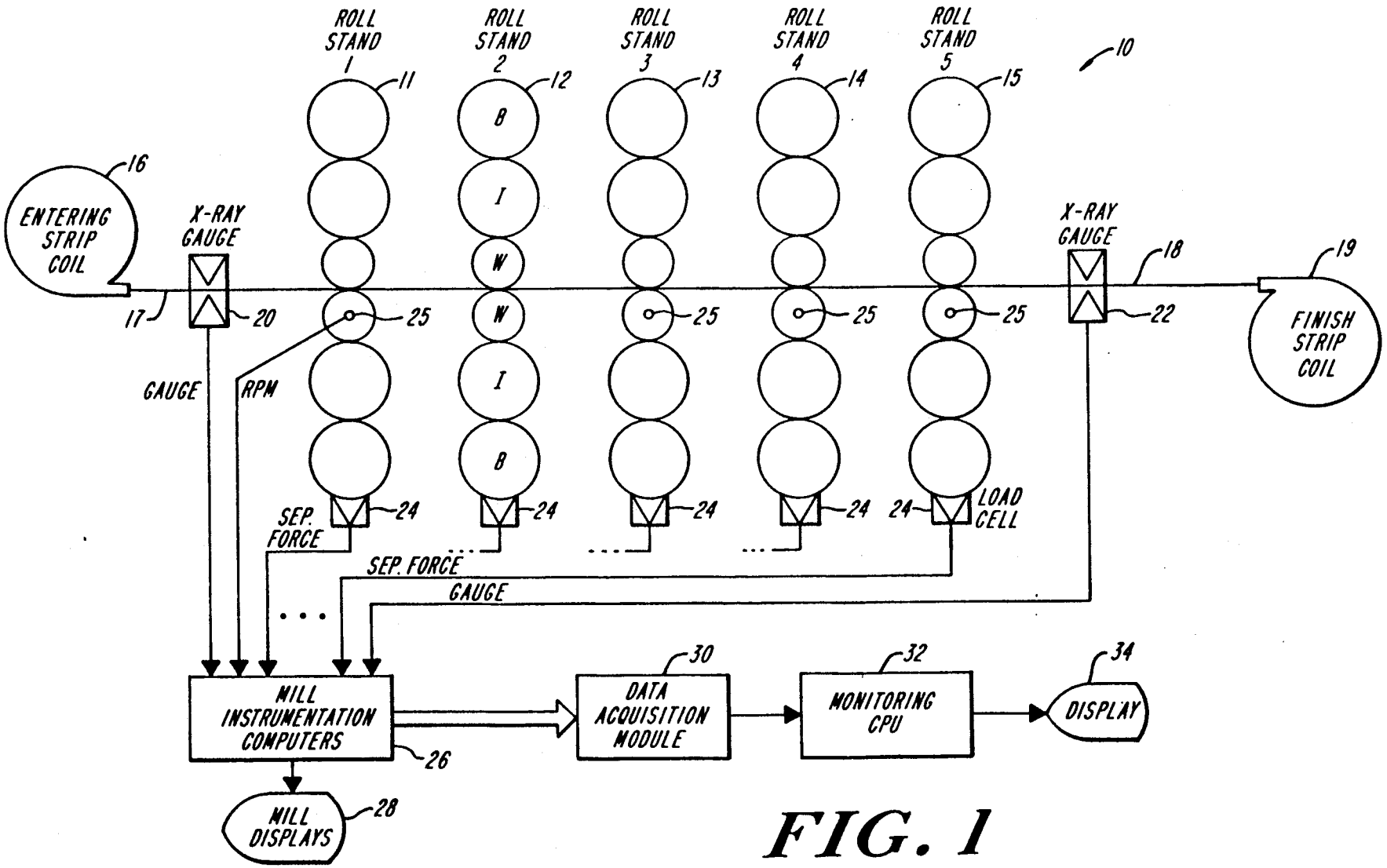
FIG. 1 shows a block diagram of a rolling mill monitoring system in accordance with the present invention.
Figure 2A:
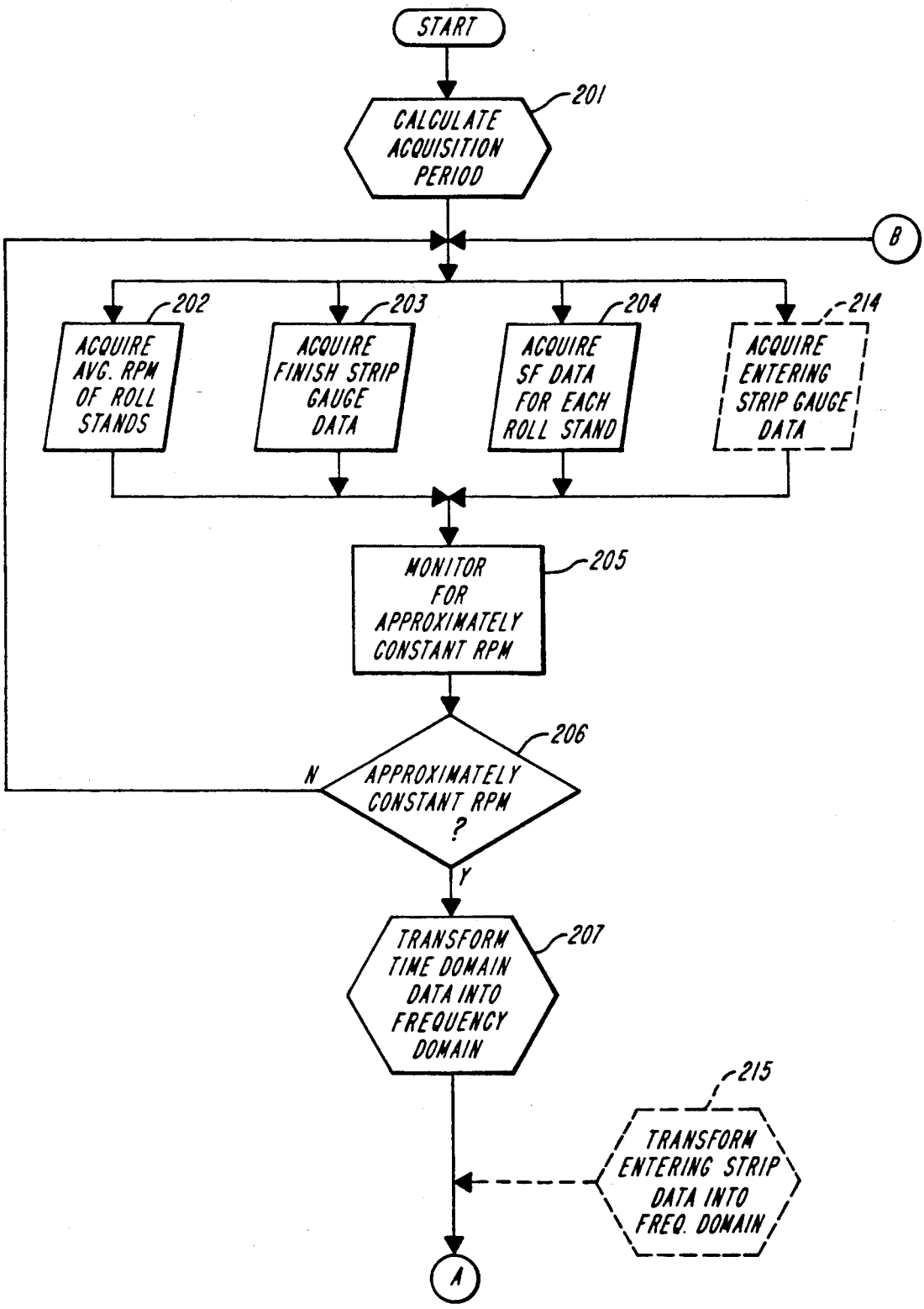
FIGS. 2A and 2B show a flow diagram of the operation of the monitoring system in accordance with the present invention.
Figure 2B:
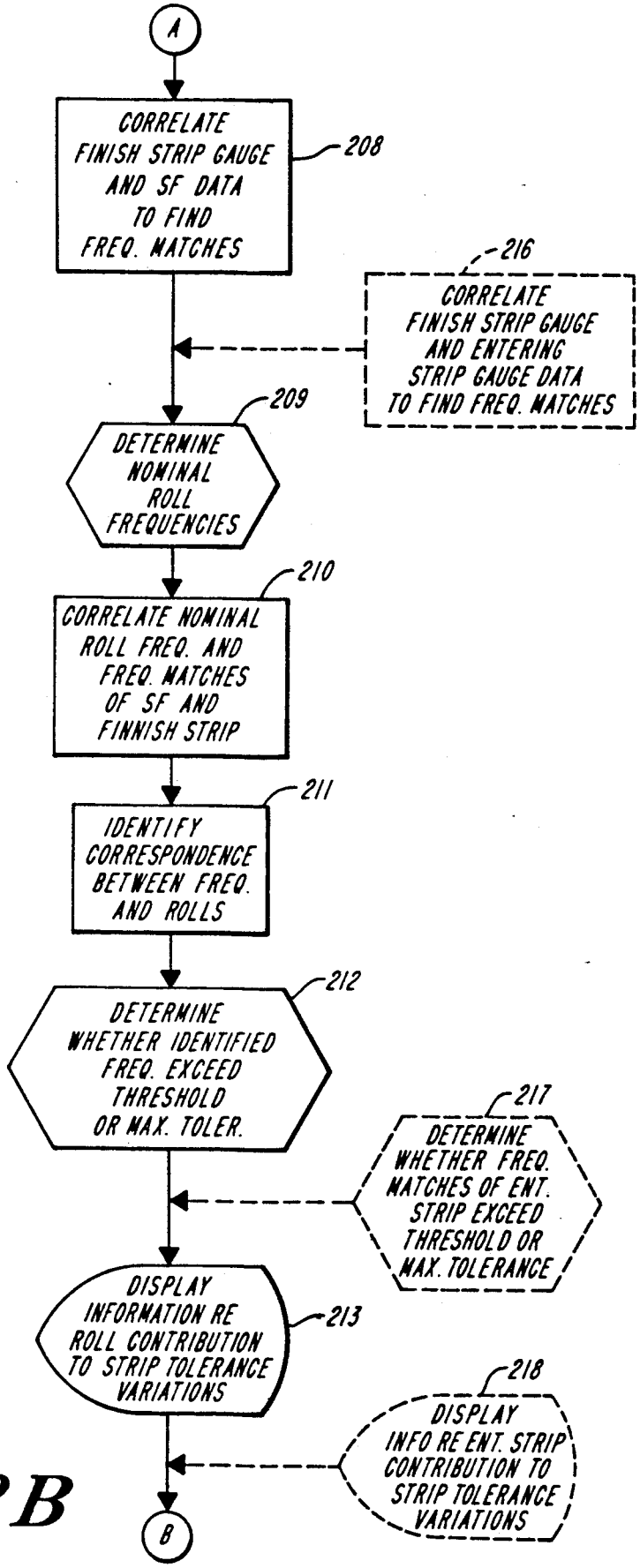

A rolling mill monitoring system 10 in accordance with the present invention is illustrated in FIG. 1. The system is used in a rolling mill having, for example, five roll stands 11, 12, 13, 14, 15. Each roll stand may have any number of roll pairs, and for exemplary purposes the roll stands herein described include a work roll pair W, an intermediate roll pair I, and a back-up roll pair B. The illustrated roll stands are representative of the stands used in either hot or cold rolling mills which roll an entering strip 17 provided from an entering strip coil 16 into a finish strip 18 that is stored as a finish strip coil 19.

Typically, each of the rolling stands are provided with a hydraulic cylinder mechanism (not shown) which is adjusted in order to increase or decrease the pressure contact between the rolls and the strip 17. Load cell transducers 24 are provided with each of the roll stands for measuring the roll load applied to the strip 17 and the separating forces experienced at each of the roll stands during the rolling operation. Hydraulic cylinders or other conventional load measuring devices may also be utilized to measure the roll load. The load cell transducers provide an analog time domain data output for down-line processing. Conventionally, this data is passed as millivolt signals to mill instrumentation computers 26 which process the separating force data into high level voltage signals. The data may be displayed to mill operators via mill displays 28. The mill computers 26 may utilize the force data measured by the load cell transducers 24 so as to adjust the hydraulic cylinder mechanisms in order to maintain desired pressure contacts or roll gap setting between each of the work rolls in the measured roll stand.

The speed of each roll stand is monitored by measurements taken by speed transducers 25. Typically the speed transducers will measure the rotational speed (RPMs) of the mill motor. As illustrated in FIG. 1. for exemplary purposes, the RPM data of the work rolls is directly proportional to the speed transducer 25 on the mill motor. The frequency of rotation of the intermediate and back-up rolls are a function of the speed of the work roll multiplied by the ratio of the work roll diameter to the intermediate roll and back-up roll diameters, respectively. Therefore, an accurate measurement of the RPM data for each of the other rolls in the roll stands may be calculated and displayed.

In accordance with the present invention, the gauge or thickness of both the finish strip 18 and the entering strip 17 are measured by an x-ray gauge 22 and an x-ray gauge 20, respectively. In the alternative, nuclear gauges or lasers may be utilized to measure the strip. The gauges operate to measure the thickness of the strip and generate analog time domain output signals which relate actual thicknesses and variations in the strip. It will be appreciated that in addition or as an alternate to measuring the entering strip gauge, the system may be configured to measure the strip gauge produced between each of the roll stands in order to derive inter-roll stand strip gauge data. The strip gauge data is also fed to the mill computers 26 for processing, and for display by the mill displays 28.

A data acquisition module 30, such as a Keithley 575 or 576 Measurement and Control System or equivalent, is provided for acquiring the time domain measurement data from the mill computers 26. The time domain measurement data is then processed by the monitoring CPU 32 in order to determine if the tolerance variations in the finish strip can be related to specific mill components contributing to the tolerance variations. The monitoring system and method according to the present invention utilizes a frequency spectrum analysis of the above mentioned measured data in order to identify the specific mill components which contribute to the tolerance variations in the finish strip. The frequency spectrum analysis is performed by the monitoring CPU 32, with the relevant information being displayed to the mill operators by display 34.

With reference now to FIGS. 2A, 2B, 3A, 3B, and 4A–4E the frequency spectrum analysis utilized in the present invention is herein described. It will be appreciated by those skilled in the art that certain predetermined parameters must be established for analyzing time domain data in the frequency domain. According to the illustrated embodiment of the present invention, the frequency domain is achieved by performing Fast Fourier Transforms (FFT) on the time domain data. Therefore, one must establish the maximum frequency to be analyzed ($f_{max}$), the time period during which data points of the time domain data are sampled (t), and the total number of sample data points (N). The relationship between these parameters is expressed by the equation:

$$f_{max}=1/t*N/2.$$

Therefore, the total period of time for sampling a specific number of data points in order to perform a FFT can be found by the equation:

$$t=N/(2*f_{max}*alias\ factor).$$

The alias factor is utilized in order to compensate for possible occurrences of aliasing in the compiled frequency domain data.

For example, a total time period of 12.8 seconds is required for data to be transformed by FFT into the frequency domain, with the maximum frequency being set at 20 Hz and the time domain data being sampled 512 times, with an aliasing factor of 1.0. Thus, the monitoring CPU 32 is able to calculate a data acquisition time period necessary for performing FFTs on the measured time domain data (Step 201).

It is preferable to approximate the rolling mill to a steady state system in order to perform accurate frequency spectrum analysis. The monitoring CPU achieves this steady state approximation by monitoring the roll RPM data acquired by the data acquisition module 30 from the mill computers 26 (Step 202). Initially, the data acquisition module acquires the average RPM of each of the rolls in the mill, and thereafter the monitoring CPU monitors same in order to determine when the mill is operating at an approximately constant speed (Step 205). The data acquisition module acquires all data virtually simultaneously or by multiplexing of signals. The monitoring CPU then determines whether the RPM is stable (approximately constant speed). If the speed is stable, the data is appropriate for analysis. If the speed is varying, the data acquisition module acquires a new set of data. Therefore, if the necessary time domain data is acquired over the calculated data acquisition time period while the mill is running at an approximately constant speed, the frequency analysis may be performed on the time domain data without the drawbacks associated with measurements taken during varying operational speeds of the mill.

The data acquisition module 30 acquires the time domain finish strip gauge data and the separating force data for each roll stand from the mill computers 26. As previously described, the mill computers receive this information from the x-ray gauge 22 and the load cell transducers 24, respectively (Steps 203 and 204). This time domain data is continuously acquired by the data acquisition module. The monitoring CPU simultaneously determines whether the monitored RPM data can be approximated to a constant speed (Step 206). If the monitoring CPU does not monitor an approximately constant RPM, the data acquisition module 30 continues to reacquire data in the time domain relating to the roll RPM, the finish strip gauge, and the separating force from the mill computers 26.

If the monitoring CPU 32 does monitor an approximately constant speed, the time domain data corresponding to the finish strip gauge and the separating force of the roll stands are transformed into the frequency domain by the monitoring CPU utilizing FFT calculations (Step 207) It will be appreciated that other conventional algorithms may be utilized to transform the time domain data into the frequency domain.

After the monitoring CPU 32 transforms the necessary time domain data into the frequency domain the monitoring CPU performs a correlation of the finish strip gauge frequency data and the separating force frequency data of each of the roll stands in order to find frequency matches (Step 208). Initially, the monitoring CPU processes the finish strip frequency data to calculate an average amplitude for all amplitude peaks occurring over the desired frequency spectrum. The calculated average amplitude is thereafter multiplied by a floating multiplier so as to establish a relative threshold in order to isolate those frequency amplitude peaks of the greatest magnitude.

The monitoring CPU then processes the measured separating force frequency domain data for each of the roll stands. An average amplitude level is calculated for each roll stand's separating force frequency domain data. Another relative threshold is iteratively set in each of the roll stand's separating force frequency domain data so that at least the same number of frequency amplitudes exceed the relative threshold as the number of frequency amplitudes which exceed the finish strip gauge threshold in the finish strip gauge frequency domain data. The finish strip gauge frequency domain data is then correlated to each roll stand's separating force frequency domain data so as to find matching frequency amplitudes that are significant.

The result of the correlation is such that if a frequency amplitude of the finish strip gauge frequency domain data matches a frequency amplitude of the separating force frequency domain data of a particular roll stand, the matched frequency amplitude indicates that particular roll stand which contributes to the frequency amplitude occurring in the finish strip frequency domain data. For example, if the finish strip gauge frequency domain data includes a frequency amplitude occurring at 4.5 Hz, and the separating force frequency domain data for roll stand 2 also includes a frequency amplitude occurring at 4.5 Hz that exceeds its threshold, it is understood that the roll stand 2 is the specific contributing factor to the tolerance variation occurring in the finish strip. If the separating force variation frequency does not exceed the threshold, there is no match. The frequency amplitude in the finish strip data is caused by something else.

The monitoring CPU 32 will next determine which particular roll pair of the roll stand is the specific contributing factor to the frequency amplitudes occurring in the finish strip gauge frequency domain data. Initially, the monitoring CPU determines the nominal roll frequencies for each of the rolls (Step 209). Having acquired the speed or RPM data for the driven roll and the calculated speed or RPM data for the other rolls in each of the roll stands, and knowing the nominal diameters (between initial diameter and last ground diameter) of each of the rolls, nominal roll frequencies for each of the rolls may be determined by the monitoring CPU 32. At this point in the process, a correlation is made between the nominal roll frequencies of each of the rolls and the frequency amplitude matches derived from correlating the finish strip gauge and the separating force frequency domain data (Step 210). After matching the nominal roll frequencies of each roll to the previously matched frequency amplitudes, the monitoring CPU 32 identifies the correspondence between the matched frequency amplitudes and the specific rolls frequency contributing to the variation in the finish strip data (Step 211).

Exemplary finish strip gauge frequency domain data and roll stand separating force frequency domain data are illustrated in FIGS. 3A and 4A–4E, respectively. A frequency amplitude occurring at 8.8 Hz in the finish strip data has been identified (3W) as corresponding to the work roll of roll stand 3 after the data correlation steps. This specific information and identification technique may be displayed on display 34 as hereinafter described. A determination is then made as to whether the identified matched frequency amplitudes exceed a floating or arbitrary threshold or thresholds, or the maximum tolerance (Step 212). This involves assigning the amplitudes from the finish strip gauge FFT to each roll. For all rolls that did not match the finish strip FFT amplitudes, the monitoring CPU assigns the roll an amplitude from the finish strip FFT that corresponds to the roll frequency, and checks that the rolls are not assigned the value of an unidentified peak. The amplitudes are then normalized to the maximum amplitude on the finish strip gauge FFT. The normalized amplitudes are then multiplied by the actual strip variation. At this point, the values correspond directly with the strip tolerance.

Following the frequency spectrum analysis, the display 34 displays information relating to specific roll contribution to the tolerance variations occurring in the strip (Step 213). For example, in accordance with one embodiment of the present invention, a graphic display of each of the rolls is presented in a color coded manner. For instance, if a particular roll is identified as operating within tolerance levels, that particular roll may be graphically displayed in the color green. If during the frequency analysis, the monitoring CPU 32 identifies a specific roll as contributing frequency amplitudes to the finish strip data which causes the strip to exceed a predetermined warning level, that particular roll may be graphically displayed in the color yellow. The use of warning levels are particularly useful in enabling mill operators to predict which rolls are close to being the specific factor in out of tolerance finish strip. Such warning indicators allow mill operators to timely schedule down time in the mill so that the particular rolls may be reground or changed. Also, those rolls which are identified as contributing a frequency amplitude which causes the strip to exceed the predetermined maximum gauge tolerance level may be graphically displayed in red. At this point the mill operators will have been notified that the finish strip is in fact out of tolerance and which rolls have specifically contributed to this situation.

The display 34 may also be configured to display a variety of other rolling mill data including the time domain data corresponding to the finish strip gauge and the separating forces of each roll, the frequency domain data of the finish strip gauge and the separating force data for each of the roll stands, and various other indications of tolerance percentages as well as the specific frequencies which have been identified with specific rolls as illustrated in FIGS. 4A–4E.

Figure 5:
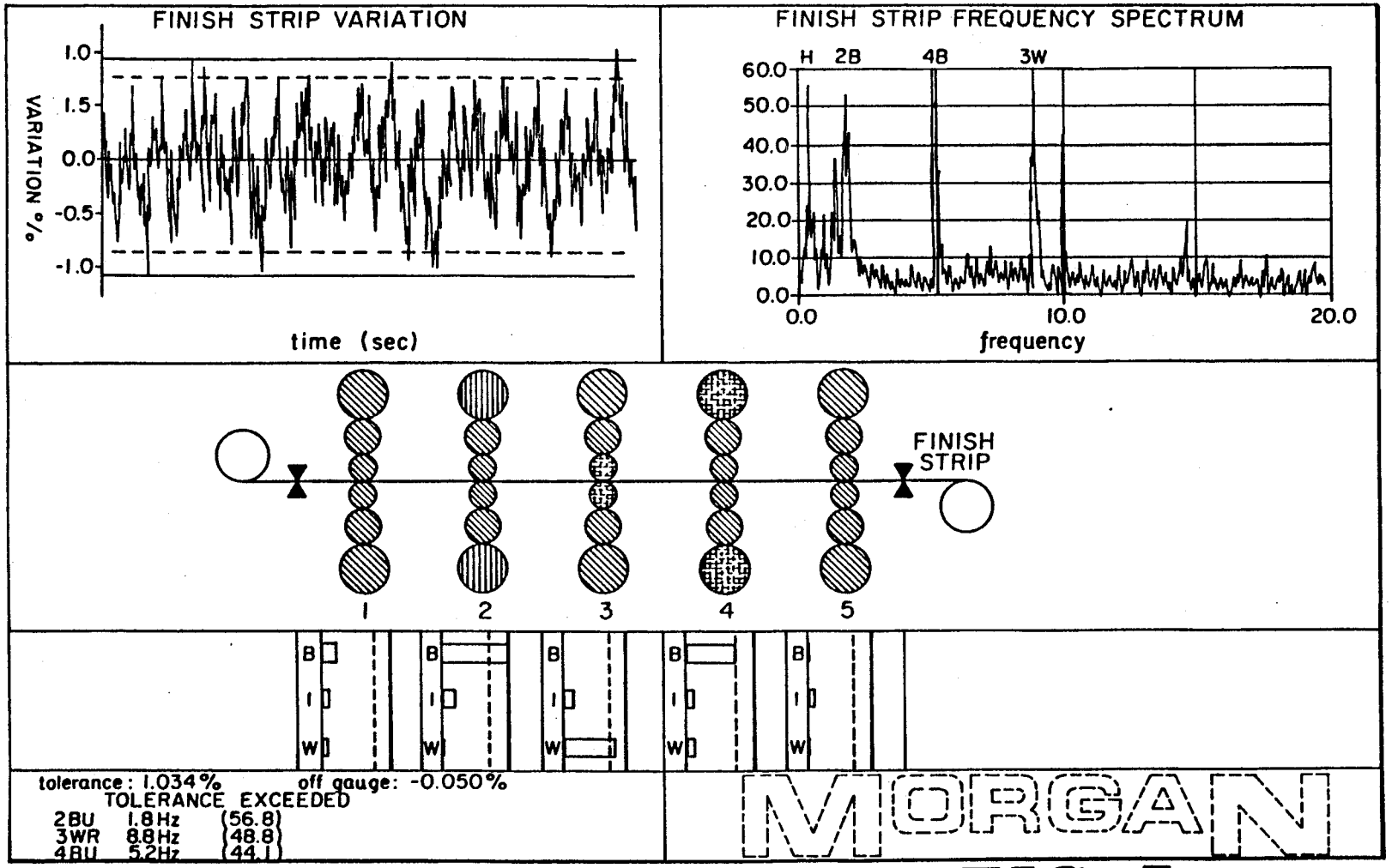
FIG. 5 shows an exemplary display of information relating to specific mill component contribution to variations in the finish strip.

FIG. 5 illustrates an exemplary display screen which displays the desired data with a color coded graphic display of the rolls, identified frequency amplitudes, and tolerance variations.

The monitoring system 10 according to the present invention may also be configured to monitor the contributions of the entering strip 17 to tolerance variations in the finish strip. As described with respect to the finish strip gauge data and the separating force data for each roll stand, the data acquisition module 30 operates to continually acquire entering strip gauge data from the x-ray gauge 20 via the mill computers 26 (Step 214). Upon the monitoring CPU 32 establishing an approximately constant speed of the rolling mill over the calculated data acquisition period, the monitoring CPU performs a FFT calculation on the entering strip gauge time domain data to transform same into the frequency domain (Step 215). A correlation is then made by the monitoring CPU between the finish strip gauge and entering strip gauge frequency domain data in order to find frequency amplitude peak matches (Step 216).

Figure 3A:
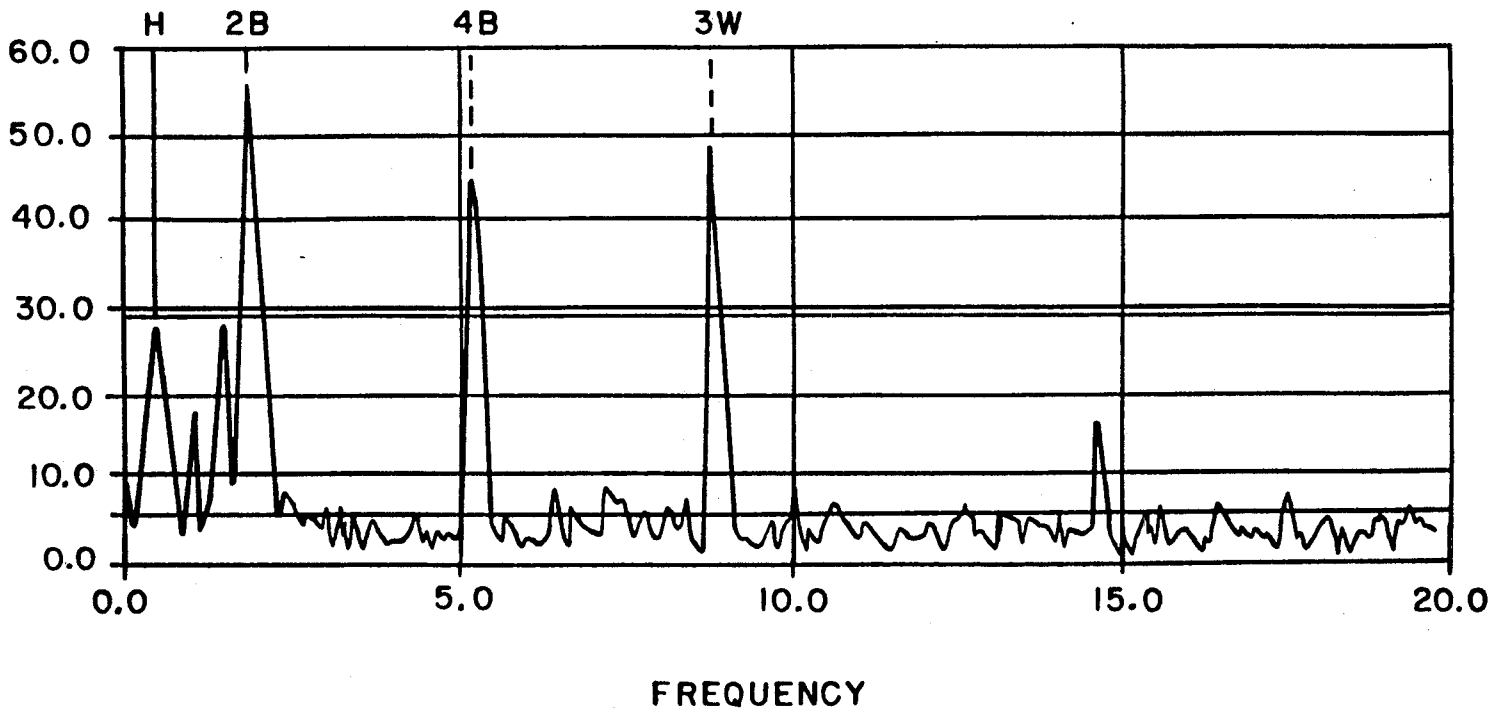
FIGS. 3A and 3B show frequency domain data corresponding to the finish strip gauge, the entering strip gauge, respectively.
Figure 3B:
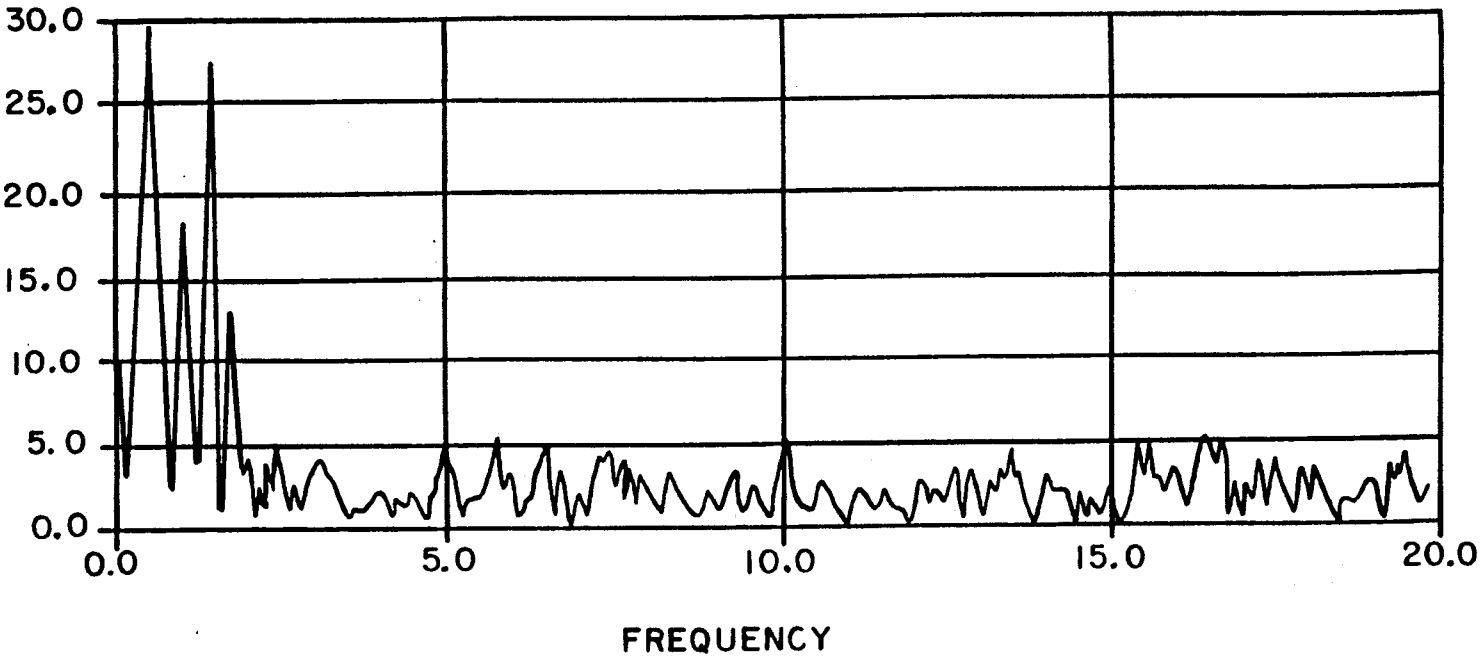
Figure 4A:
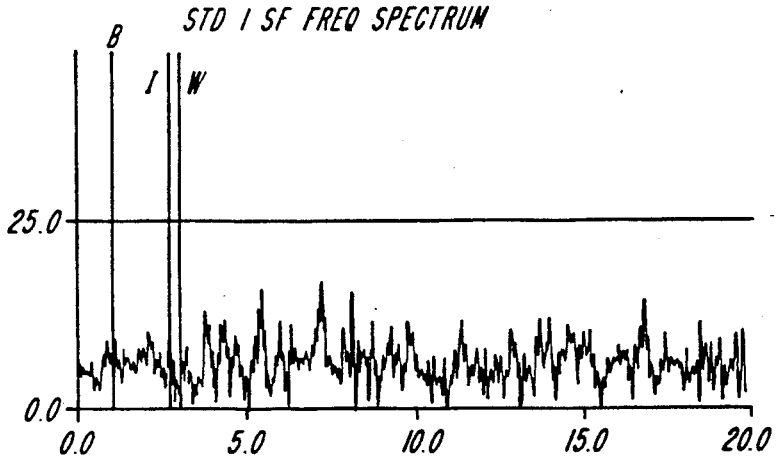
FIGS. 4A–4E show the frequency domain data corresponding to the separating forces of the roll stands.
Figure 4C:
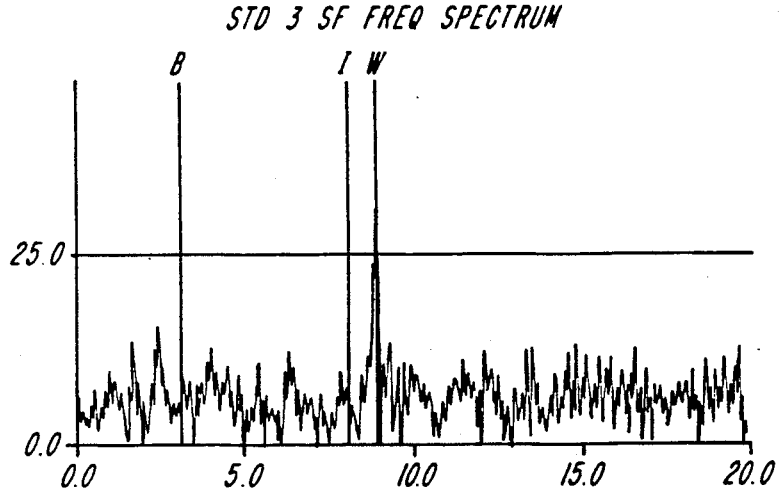
Figure 4E:
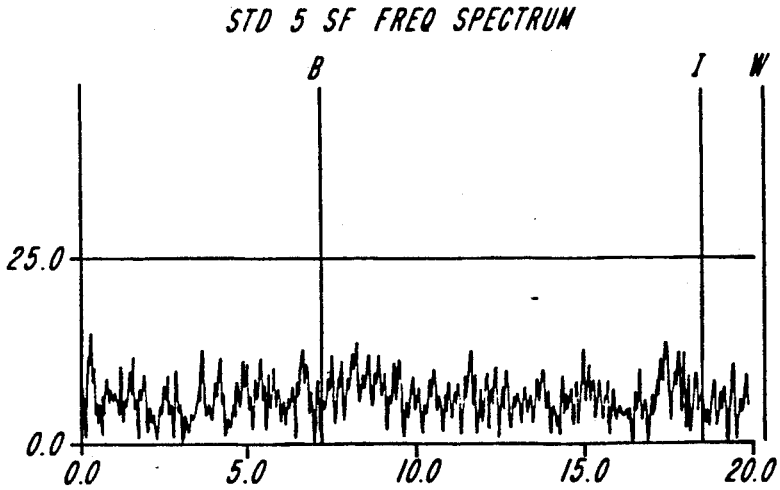
Figure 4B:
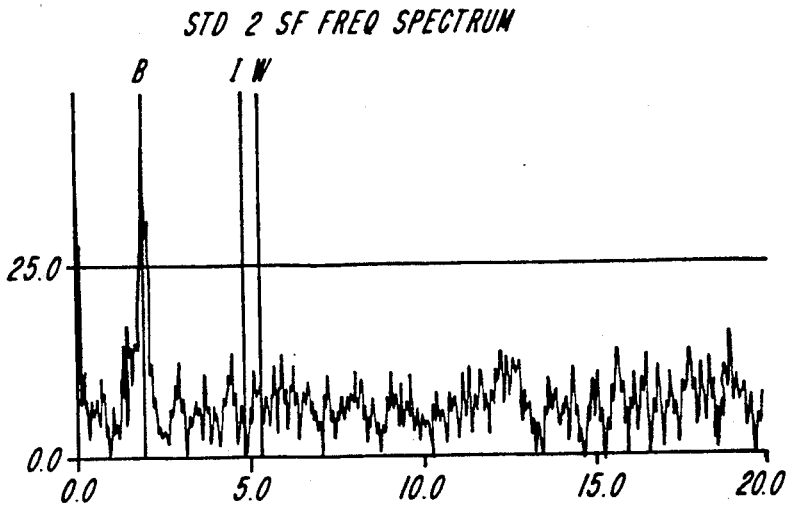
Figure 4D:
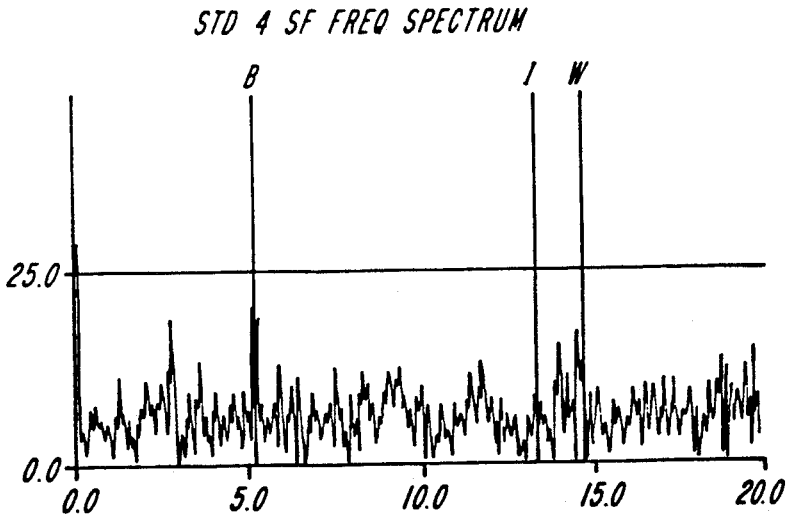

A determination is then made by the monitoring CPU as to whether the significant frequencies of the entering strip and finish strip gauge data match. If the normalized amplitudes from the finish strip gauge FFTs multiplied by the actual strip variation exceed the levels set by the mill operators, the display 34 may graphically display the contribution of the entering strip to the tolerance variations in the finish strip in the previously described color coded manner (Step 218). Typically, frequency amplitude peaks corresponding to the entering strip occur at or below 2 Hz. FIG. 3B illustrates exemplary entering strip frequency domain data which shows a contribution of a frequency amplitude peak occurring at 0.4 Hz in the finish strip data.

It will be appreciated by those skilled in the art that the above described analysis may be carried out with respect to the inter-roll stand strip gauge data as an addition to or alternate to the process of analyzing the entering strip gauge data.

The display 34 may also be configured to display the entering strip gauge or the inter-roll stand strip gauge time domain data, or the entering strip gauge or the inter-roll stand strip gauge frequency domain data as desired.

Having shown an illustrated embodiment, those skilled in the art will realize many variations are possible which will still be within the scope and spirit of the claimed invention. Therefore, it is the intention to limit the invention only as indicated by the scope of the claims.

What is claimed is:

1. A rolling mill monitoring system for use in a rolling mill to identify specific contributions to out of tolerance finish product, said rolling mill having a plurality of roll stands which support a plurality of rolls for rolling an entering product into a finish product, said system comprising:

means for establishing a data acquisition time period;

means for calculating roll frequency data corresponding to nominal roll frequencies of each of said rolls;

means for acquiring data corresponding to measured separating forces at each roll stand while rolling said product, said measured separating forces data being acquired over said acquisition time period;

means for acquiring data corresponding to measured gauge of said finish product after being rolled by said roll stands, said measured finish product gauge data being acquired over said data acquisition time period;

means for transforming said measured separating forces data and said measured finish product gauge data into the frequency domain so as to obtain frequency amplitude data corresponding to each of said measured separating forces and finish product gauge;

means for correlating said frequency amplitude data corresponding to said measured separating forces, said measured finish product gauge, and said nominal roll frequency data of each roll in order to derive matched frequency amplitude data which corresponds to each roll; and means for determining, in accordance with said matched frequency amplitude data, which of the rolls are contributing to the out of tolerance finish product.

2. The system of claim 1 further comprising means for monitoring rotational speed of said rolls in order to determine whether said rolls are operating at approximately constant speed over said data acquisition time period.

3. The system of claim 2, wherein said transforming means transforms said data in response to said monitoring means determining that said rolls are operating at approximately constant speed over said data acquisition time period.

4. The system of claim 1, wherein said means for determining determines whether the matched frequency amplitudes corresponding to each roll causes said finish strip gauge data to exceed at least one predetermined limit.

5. The system of claim 4 further comprising means for identifying rolls having corresponding matched frequency amplitude peaks that exceed said at least one predetermined limit.

6. The system of claim 5 further comprising means for displaying an indication of those rolls identified as having corresponding matched frequency amplitudes that exceed said at least one predetermined limit.

7. The system of claim 6 further comprising means for acquiring data corresponding to measured gauge of prefinished product over said data acquisition time period.

8. The system of claim 7, wherein said means for transforming transforms said measured prefinished product gauge data into the frequency domain so as to obtain frequency amplitude data corresponding to said measured prefinished product gauge.

9. The system of claim 8, wherein said transforming means transforms said data in response to a monitoring means determining that said rolls are operating at approximately constant speed over said data acquisition time period.

10. The system of claim 8, wherein said means for correlating correlates said frequency amplitude data corresponding to said measured finish product gauge data and said measured prefinished product gauge data in order to derive matched frequency amplitude data which corresponds frequency amplitude associated with said prefinished product gauge with frequency amplitude associated with said finish product gauge.

11. The system of claim 10, wherein said means for determining determines whether the matched frequency amplitude corresponding to said prefinished product gauge causes said finish strip gauge data to exceed at least one predetermined limit.

12. The system of claim 11, wherein said means for identifying identifies said prefinished product as having corresponding matched frequency amplitudes that cause said finish product gauge data to exceed said at least one predetermined limit.

13. The system of claim 12, wherein said means for displaying displays an indication that said prefinished product has corresponding matched frequency amplitudes that exceed said at least one predetermined limit.

14. The system of claims 6 or 13, wherein said at least one predetermined limit corresponds to a predetermined maximum gauge tolerance level.

15. The system of claim 14, wherein said at least one predetermined limit comprises a first limit which when exceeded provides an indication that said finish product is approaching said predetermined maximum gauge tolerance level.

16. The system of claim 15, wherein said at least one predetermined limit comprises a second limit which when exceeded provides an indication that said finish product is exceeding said predetermined maximum gauge tolerance level.

17. The system of claim 16, wherein said means for acquiring data corresponding to measured gauge of prefinished product acquires entering product gauge data.

18. The system of claim 16, wherein said means for acquiring data corresponding to measured gauge of prefinished product acquires inter-roll stand product gauge data.

19. A method for monitoring a rolling mill to identify specific contributions to out of tolerance finish product, said rolling mill having a plurality of roll stands which support a plurality of rolls for rolling an entering product into a finish product, said method comprising the steps of:

establishing a data acquisition time period;

acquiring roll frequency data corresponding to nominal roll frequencies of each of said rolls;

acquiring data corresponding to measured separating forces at each roll stand while rolling said product, said measured separating forces data being acquired over said acquisition time period;

acquiring data corresponding to measured gauge of said finish product after being rolled by said roll stands over said data acquisition time period;

transforming said measured separating forces data and said measured finish product gauge data into the frequency domain so as to obtain frequency amplitude data corresponding to each of said measured separating forces and finish product gauge;

correlating said frequency amplitude data corresponding to said measured separating forces, said measured finish product gauge, and said nominal roll frequency data of each roll in order to derive matched frequency amplitude data which corresponds to each roll; and determining, in accordance with said matched frequency amplitude data, which of the particular rolls are contributing to the out of tolerance finish product.

20. The method of claim 19 further comprising the step of monitoring rotational speed of said rolls in order to determine whether said rolls are operating at an approximate constant speed over said data acquisition time period.

21. The method of claim 20, wherein the step of transforming is carried out in response to determining that said rolls are operating at approximately constant speed over said data acquisition time period.

22. The method of claim 21 further comprising the step of determining whether the matched frequency amplitudes corresponding to each roll cause said finish strip gauge data to exceed at least one predetermined limit.

23. The method of claim 22 further comprising the step of identifying rolls having corresponding matched frequency amplitudes that cause said finish strip gauge data to exceed said at least one predetermined limit.

24. The method of claim 23 further comprising the step of displaying an indication of those rolls identified as having corresponding matched frequency amplitudes that cause said finish strip gauge data to exceed said at least one predetermined limit.

25. The method of claim 24 further comprising the step of acquiring data corresponding to measured gauge of prefinished product over said data acquisition time period.

26. The method of claim 25, wherein the step of acquiring data corresponding to measured gauge of prefinished product involves acquiring entering product gauge data.

27. The method of claim 25, wherein the step of acquiring data corresponding to measured gauge of prefinished product involves acquiring inter-roll stand product gauge data.

28. The method of claim 25 further comprising the step of transforming said measured prefinished product gauge data into the frequency domain so as to obtain frequency amplitude data corresponding to said measured prefinished product gauge.

29. The method of claim 28 further comprising the step of correlating said frequency amplitude data corresponding to said measured finish product gauge data and said measured prefinished product gauge data in order to derive matched frequency amplitude data which corresponds frequency amplitudes associated with said prefinished product gauge with frequency amplitudes associated with said finish product gauge.

30. The method of claim 29 further comprising the step of determining whether the matched frequency amplitudes corresponding to said prefinished product gauge cause said finish strip gauge data to exceed said at least one predetermined limit.

31. The method of claim 30 further comprising the steps of identifying said prefinished product as having corresponding matched frequency amplitudes that cause said finish strip gauge data to exceed said at least one predetermined limit.

32. The method of claim 31 further comprising the step of displaying an indication that said prefinished product has corresponding matched frequency amplitudes that cause said finish strip gauge data to exceed said at least one predetermined limit.

33. The method of claims 24 or 32, wherein said at least one predetermined limit corresponds to a predetermined maximum gauge tolerance level.

34. The method of claim 33, wherein said at least one predetermined limit comprises a first limit which when exceeded provides an indication that said finish product is approaching said predetermined maximum gauge tolerance level.

35. The method of claim 34, wherein said at least one predetermined limit comprises a second limit which when exceeded provides an indication that said finish product is exceeding said predetermined maximum gauge tolerance level.

36. A rolling mill monitoring system for use in a rolling mill to identify specific contributions to out of tolerance finish product, said rolling mill having a plurality of roll stands which support a plurality of rolls for rolling an entering product into a finish product, said system comprising:

means for establishing a data acquisition time period;

means for acquiring data corresponding to measured gauge of prefinished product, said measured prefinished product gauge data being acquired over said acquisition time period;

means for acquiring data corresponding to measured gauge of said finish product after being rolled by said roll stands, said measured finish product gauge data being acquired over said data acquisition time period;

means for transforming said measured prefinished product gauge data and said measured finish product gauge data into the frequency domain so as to obtain frequency amplitude data corresponding to each of said measured prefinished product gauge and finish product gauge;

means for correlating said frequency amplitude data corresponding to said measured prefinished product gauge and said measured finish product gauge in order to derive matched frequency amplitude data; and means for determining, in accordance with said matched frequency amplitude data, whether said prefinished product contributes to the out of tolerance finish product.

37. The system of claim 36, wherein said means for acquiring data corresponding to measured gauge of prefinished product acquires entering product gauge data.

38. The system of claim 36, wherein said means for acquiring data corresponding to measured gauge of prefinished product acquires inter-roll stand product gauge data.

39. The system of claim 36 further comprising means for monitoring rotational speed of said rolls in order to determine whether said rolls are operating at approximately constant speed over said data acquisition time period.

40. The system of claim 39, wherein said transforming means transforms said data in response to said monitoring means determining that said rolls are operating at approximately constant speed over said data acquisition time period.

41. The system of claim 40, wherein said transforming means transforms said data in response to a monitoring means determining that said rolls are operating at approximately constant speed over said data acquisition time period.

42. The system of claim 39, wherein said means for determining determines whether the matched frequency amplitude corresponding to said prefinished product gauge causes said finish strip gauge data to exceed at least one predetermined limit.

43. The system of claim 42, wherein said means for identifying identifies said prefinished product as having corresponding matched frequency amplitudes that cause said finish product gauge data to exceed said at least one predetermined limit.

44. The system of claim 43, wherein said means for displaying displays an indication that said prefinished product has corresponding matched frequency amplitudes that exceed said at least one predetermined limit.

45. The system of claim 44, wherein said at least one predetermined limit corresponds to a predetermined maximum gauge tolerance level.

46. The system of claim 45, wherein said at least one predetermined limit comprises a first limit which when exceeded provides an indication that said finish product is approaching said predetermined maximum gauge tolerance level.

47. The system of claim 46, wherein said at least one predetermined limit comprises a second limit which when exceeded provides an indication that said finish product is exceeding said predetermined maximum gauge tolerance level.

48. A method for monitoring a rolling mill to identify specific contributions to out of tolerance finish product, said rolling mill having a plurality of roll stands which support a plurality of rolls for rolling an entering product into a finish product, said method comprising the steps of:

establishing a data acquisition time period;

acquiring data corresponding to measured gauge of prefinished product, said measured prefinished product gauge data being acquired over said acquisition time period;

acquiring data corresponding to measured gauge of said finish product after being rolled by said roll stands over said data acquisition time period;

transforming said measured prefinished product gauge data and said measured finish product gauge data into the frequency domain so as to obtain frequency amplitude data corresponding to each of said measured prefinished product gauge and finish product gauge;

correlating said frequency amplitude data corresponding to said measured prefinished product gauge and said measured finish product gauge in order to derive matched frequency amplitude data; and determining, in accordance with said matched frequency amplitude data, whether said prefinished product contributes to the out of tolerance finish product.

49. The method of claim 48, wherein the step of acquiring data corresponding to measured gauge of prefinished product involves acquiring entering product gauge data.

50. The method of claim 48, wherein the step of acquiring data corresponding to measured gauge of prefinished product involves acquiring inter-roll stand product gauge data.

51. The method of claim 48 further comprising the step of monitoring rotational speed of said rolls in order to determine whether said rolls are operating at an approximate constant speed over said data acquisition time period.

52. The method of claim 51, wherein the step of transforming is carried out in response to determining that said rolls are operating at approximately constant speed over said data acquisition time period.

53. The method of claim 52 further comprising the step of determining whether the matched frequency amplitudes corresponding to said prefinished product gauge cause said finish strip gauge data to exceed said at least one predetermined limit.

54. The method of claim 53 further comprising the steps of identifying said prefinished product as having corresponding matched frequency amplitudes that cause said finish strip gauge data to exceed said at least one predetermined limit.

55. The method of claim 54 further comprising the step of displaying an indication that said prefinished product has corresponding matched frequency amplitudes that cause said finish strip gauge data to exceed said at least one predetermined limit.

56. The method of claim 55, wherein said at least one predetermined limit corresponds to a predetermined maximum gauge tolerance level.

57. The method of claim 56, wherein said at least one predetermined limit comprises a first limit which when exceeded provides an indication that said finish product is approaching said predetermined maximum gauge tolerance level.

58. The method of claim 57, wherein said at least one predetermined limit comprises a second limit which when exceeded provides an indication that said finish product is exceeding said predetermined maximum gauge tolerance level.

* * * * *